United States Patent [19]

Fawcett et al.

[11] 4,280,325

[45] Jul. 28, 1981

[54] UNIDIRECTIONAL ENERGY CONVERTER

[75] Inventors: Sherwood L. Fawcett, Columbus; James N. Anno, Cincinnati, both of Ohio

[73] Assignee: Battelle Development Corporation, Columbus, Ohio

[21] Appl. No.: 171,806

[22] Filed: Jul. 24, 1980

Related U.S. Application Data

[63] Continuation-in-part of Ser. No. 2,411, Jan. 11, 1979, abandoned, which is a continuation-in-part of Ser. No. 872,848, Jan. 27, 1978, abandoned.

[51] Int. Cl.[3] ..... F03G 7/00

[52] U.S. Cl. ..... 60/370; 60/721

[58] Field of Search ..... 60/325, 370, 650, 682, 60/721, 407

[56] References Cited

U.S. PATENT DOCUMENTS

| | | | |
|---|---|---|---|
| 3,859,789 | 1/1975 | Fawcett et al. | 60/370 X |
| 3,927,329 | 12/1975 | Fawcett et al. | 60/325 X |
| 4,117,696 | 10/1978 | Fawcett et al. | 60/325 X |
| 4,155,224 | 5/1979 | Hopping et al. | 60/370 X |
| 4,179,885 | 12/1979 | Hopping et al. | 60/370 |

*Primary Examiner*—Allen M. Ostrager

*Attorney, Agent, or Firm*—Thomas H. Murray

[57] ABSTRACT

Thermal energy is converted into rotational energy by using the expansion of a fluid medium to propel a plurality of pistons within at least one continuous, closed-loop passageway mounted on a rotatable platform. In at least one region of the passageway, the pistons must move inwardly against centrifugal force as the platform rotates. In at least one other region of the passageway, the pistons are moved outwardly under the influence of centrifugal force. Means are provided for imparting force to successive ones of the pistons to propel them against centrifugal force in said one region; while means are provided for converting the energy of pistons moving outwardly under the influence of centrifugal force in said other region into rotational energy. This rotational energy is used to drive gears mounted on the platform which mesh with a stationary gear carried beneath the platform to cause rotation of the platform about its rotational axis. The energy used to accelerate the pistons is thereby converted into rotational energy of the platform. In one embodiment of the invention, at least two continuous, closed-loop passageways are used on the platform in order to prevent an unbalanced condition. In another embodiment of the invention, a single passageway is used on the platform comprising two essentially straight portions on opposite sides of the axis of rotation of the platform interconnected at their opposite ends by curved portions, also on opposite sides of the axis of rotation of the platform. By forcibly rotating the platform in reverse, the invention can be used as a compressor.

40 Claims, 10 Drawing Figures

UNIDIRECTIONAL ENERGY CONVERTER

CROSS-REFERENCES TO RELATED APPLICATIONS

This application is a continuation-in-part of copending application Ser. No. 002,411, filed Jan. 11, 1979, now abandoned, which is a continuation-in-part of application Ser. No. 872,848, filed Jan. 27, 1978, now abandoned.

BACKGROUND OF THE INVENTION

As is known, systems have been proposed in the past to convert one type of energy into another type by using various thermodynamic cycles, such as the Otto, Rankine and Brayton cycles. Most of these systems employ reciprocating pistons; although some, such as those shown in Dutch Pat. No. 65,164 and German Pat. No. 842,845, employ one or more pistons which are forced to travel in one direction in a continuous closed-loop by the expansion of a gaseous medium in one region of the closed loop. In the closed-loop systems of the prior art, each piston is coupled to a mechanical element which moves with it, the kinetic energy of the moving piston being converted directly into mechanical energy. These systems, however, require complicated mechanisms for coupling the piston or pistons to an associated mechanical element.

In U.S. Pat. No. 3,859,789, a method and apparatus are disclosed for converting one form of energy into another form of energy through the use of a single continuous, closed-loop passageway containing a plurality of freely-movable, mechanically-unrestrained bodies which travel around the passageway in one direction only. Acceleration of the bodies is effected by means of an expanding fluid medium supplied externally to the closed-loop passageway or by means of internal combustion. The kinetic energy of the bodies is extracted by a variety of methods including causing the propelled bodies, when formed from magnetically-permeable material, to pass through an electromagnetic field to convert some of the kinetic energy into electrical energy. Kinetic energy is also extracted by compressing the fluid between the bodies to provide energy in the form of compressed fluid. When the expansion of a gas is used to propel the bodies in this type of energy converter, the bodies pass through a region where the gas between them is compressed preparatory to a succeeding cycle of operation. In all such prior art systems of this type, the closed-loop passageway itself remains stationary.

SUMMARY OF THE INVENTION

It is an object of the present invention to provide an improved unidirectional energy converter in the form of a rotating engine wherein pistons are accelerated around a closed-loop passageway mounted on a rotating platform. Energy in the form of an expanding gas is converted into kinetic energy which is then converted into potential energy by working the pistons against the centrifugal force of the rotating platform. Finally, the pistons are moved radially outwardly on the platform under the influence of centrifugal force; and their energy is converted into rotational energy which is used to rotate the platform and provide useful work.

In accordance with one embodiment of the invention, the apparatus for converting a first form of energy into a second form of energy includes a platform carried by support means for rotation about a central axis. At least one continuous, closed-loop passageway is carried by the platform and contains a plurality of freely-movable pistons. Means are provided for applying a force to successive ones of the pistons in a first region of the passageway extending along the periphery of the rotating platform to thereby propel each body in one direction around the passageway and increase its kinetic energy. In a second region of the passageway which curves inwardly toward the center of the platform the pistons, after being propelled, are caused to work against centrifugal force to thereby convert the kinetic energy of the pistons into potential energy as they approach the center of rotation of the platform. In a third, radially-extending region of the passageway centrifugal force acts on the pistons causing them to move radially outwardly back to the first region. In the third region the energy of the outwardly-moving pistons is converted into rotational energy which is then coupled to the platform to rotate the same.

Preferably, in the embodiment of the invention just described, there are two closed-loop passageways located at diametrically-opposite locations on the rotating platform. Each passageway includes two arcuate segments, each having a different radius, and a linear segment interconnecting the two arcuate segments. When the apparatus of the invention is adapted for operation according to the Rankine cycle, a rotary union communicates with a duct extending coaxially along a support shaft for the platform; while conduits extend from the duct to the first region of each passageway to supply steam or the like as the expansible fluid from a stationary boiler. A second duct can be connected by conduits to each second region of the passageways for exhausting steam therefrom. The rotatable means for each passageway includes at least one but preferably two pocketed wheels disposed at opposite sides of the passageway for receiving the pistons as they are moved radially outwardly along the linear regions of the passageways under the influence of centrifugal force. These pocketed wheels also serve to feed the pistons into the first region where they are propelled by expansion of a fluid. The pocketed wheels are secured to arbors which are, in turn, rotatably supported by the platform and coupled by gears in a stationary gear which is coaxial with the central axis of the platform. The rotational movement of the pocketed wheels is thereby converted into rotational movement of the platform. Typically, the pocketed wheels at opposite sides of the linear region of the passageway include circumferentially-spaced peripheral pockets to pass the pistons between the wheels. Alternatively, the wheels may have spaced-apart magnets on their peripheries, all of the magnets carried by one wheel having magnetic south poles and those carried by the other wheel having magnetic north poles at their respective peripheries.

When the aforesaid embodiment of the invention is adapted for operation according to the Brayton cycle, liquid fuel is fed from a stationary tank through a coaxial pipeline to the rotating platform. An inlet manifold and an exhaust manifold communicate with only part of the opposite sides of the aforesaid second arcuate region of each passageway. The remaining part of the second region is used to compress air between the bodies. The compressed air is then fed to a combustion chamber where it is heated and used to propel the pistons in the first region of each passageway.

In another embodiment of the invention, a single passageway, rather than two, is provided on the rotatable platform. In this case, the passageway has straight portions on opposite sides of the central axis of rotation of the platform, the straight portions being interconnected at their ends by curved portions, also on opposite sides of the central axis of rotation of the platform. Means are provided for applying a force to successive ones of the pistons in one region in each of said straight portions of the passageway to propel them inwardly on the rotating platform against centrifugal force, the pistons being moved radially outwardly in another region of each of the straight portions under centrifugal force. The means for converting the energy of the pistons into rotational energy comprises pocketed wheels having their peripheries coinciding with the inner peripheries of the curved portions of the passageway to convert the energy of the pistons in the curved portions, which have been moved outwardly under centrifugal force, into rotational energy. As in the previous embodiment, these pocketed wheels are coupled through a gear train mounted on the platform which meshes with a stationary gear carried beneath the platform to cause rotation of the platform about its rotational axis.

It will be appreciated from the following description that by driving the rotating platform of the invention in reverse, the device can be used as a compressor rather than an engine. In this case, rotational energy is converted into compressed gas with the aforesaid pocketed wheels forcing the pistons radially inwardly in the closed-loop passageway. The pistons are then forced radially outwardly; while air is drawn into the passageway through the ducts which function as exhaust ports during operation as an engine. The radially-propelled pistons then move back to the pocketed wheels while they compress air which is expelled through the duct which acts as an intake port during operation as an engine.

Finally, it will be appreciated that a number of rotating platforms of the type described above can be coaxially mounted on, and secured to, a single shaft such that a number of energy converters effectively operate in parallel.

The above and other objects and features of the invention will become apparent from the following detailed description taken in connection with the accompanying drawings which form a part of this specification, and in which.

Figure 1:
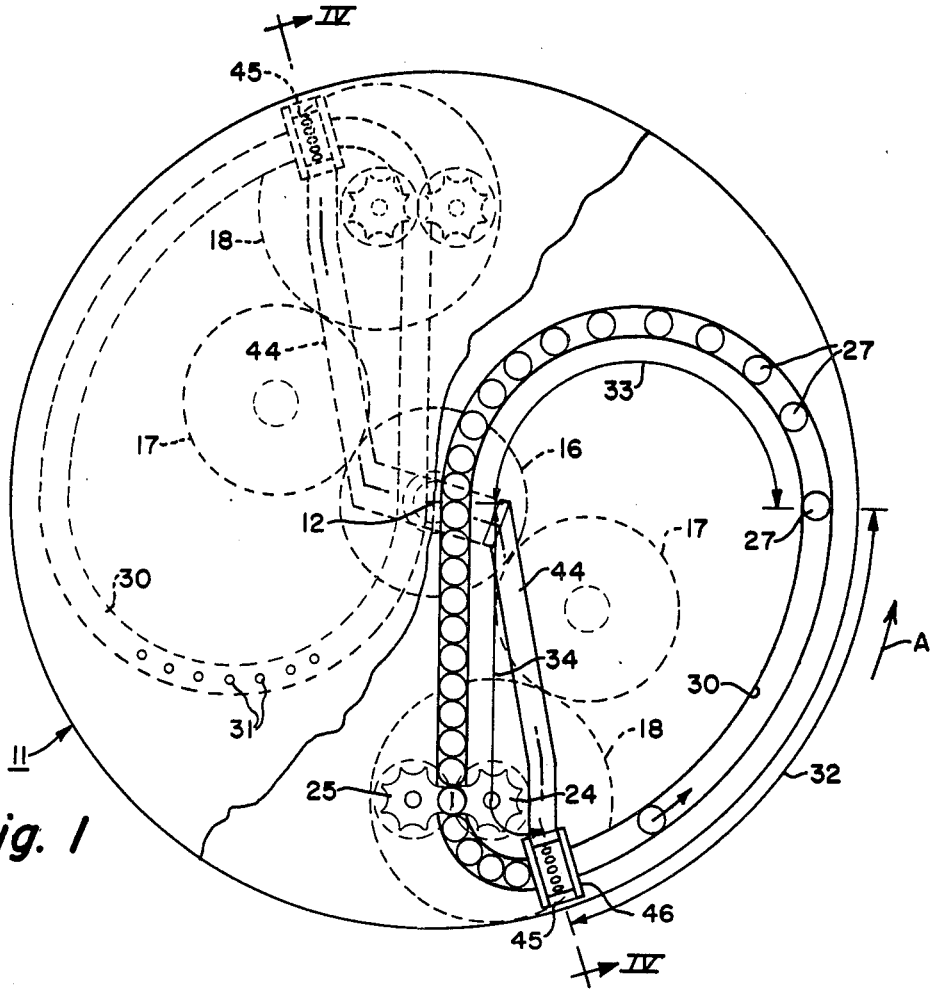
FIG. 1 is a plan view of the rotating engine according to one embodiment of the present invention for converting, according to the Rankine cycle, one form of energy into a second form of energy.

With reference now to FIGS. 1–5, the rotating engine shown includes a platform 11 in the form of two disc-shaped plates 11A and 11B (FIGS. 3 and 4) with mutually-engaging face surfaces maintained in contact by fastening members, not shown. The platform is adapted to rotate about a central vertical axis 12 (FIG. 4) and is secured by fasteners to a centrally-arranged shaft 13 extending downwardly from the bottom of plate 11B of the platform. Bearings 14 support the shaft 13 for rotation within a support frame 15. A stationary main gear 16 is keyed to a journal surface provided on frame 15. As is perhaps best shown in FIGS. 1 and 5, the diameter of gear 16 is selected so that it meshes with two separate gear trains, each being identical and including a first idler gear 17 and a second idler gear 18. The gears 17, for example, are supported by bearings on arbor shafts 19 (FIGS. 4 and 5) carried by plate 11B.

Figure 2:
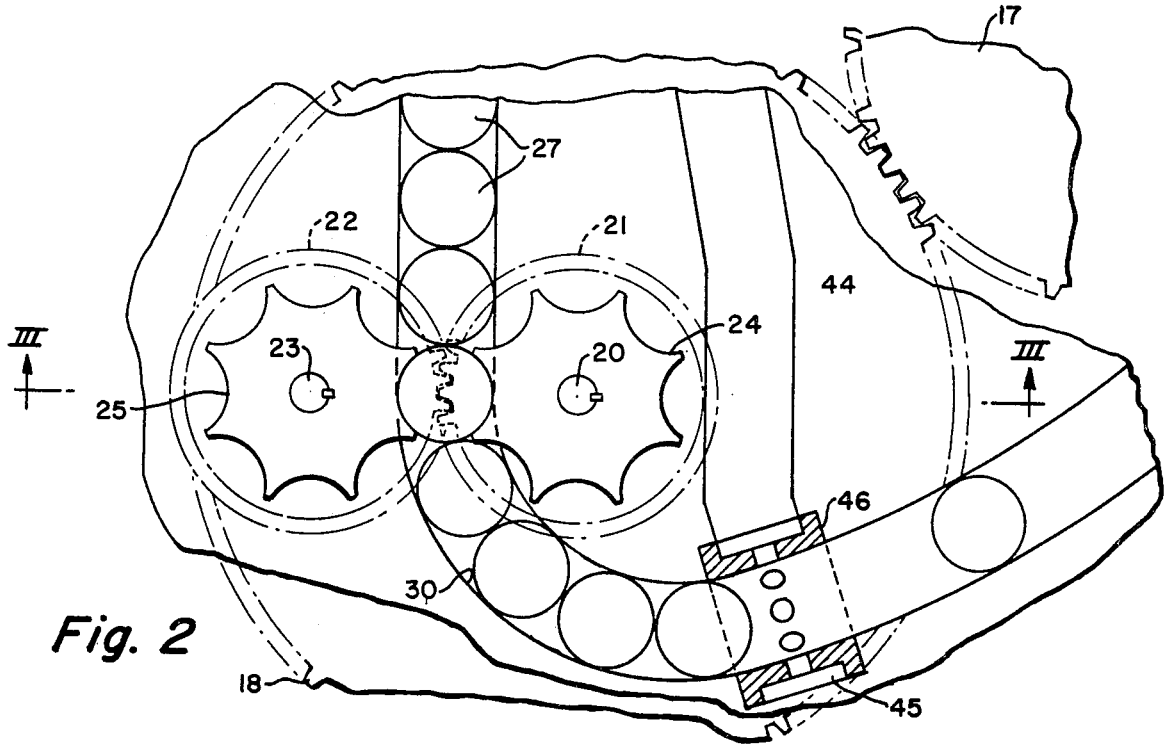
FIG. 2 is an enlarged plan view of the pocketed wheels of the invention for feeding pistons forming part of the apparatus shown in FIG. 1.
Figure 3:
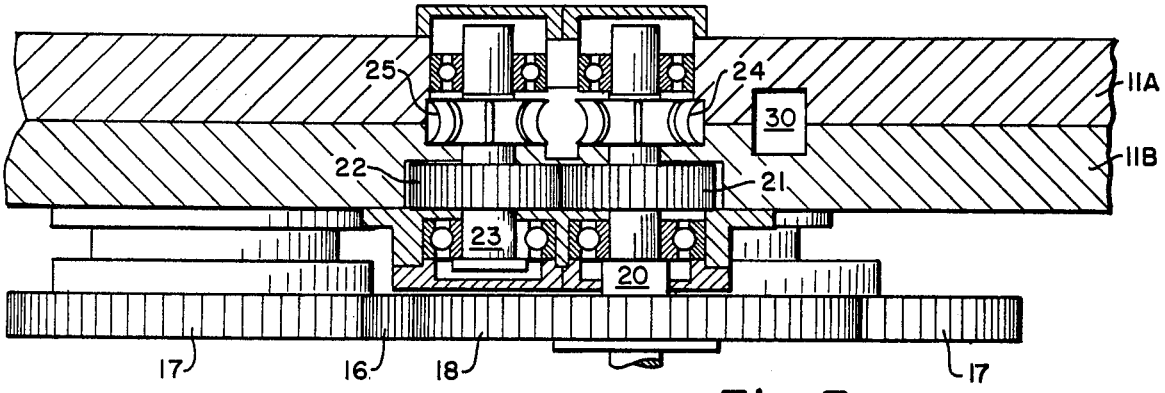
FIG. 3 is a cross-sectional view taken along line III—III of FIG. 2.
Figures 4, 5:
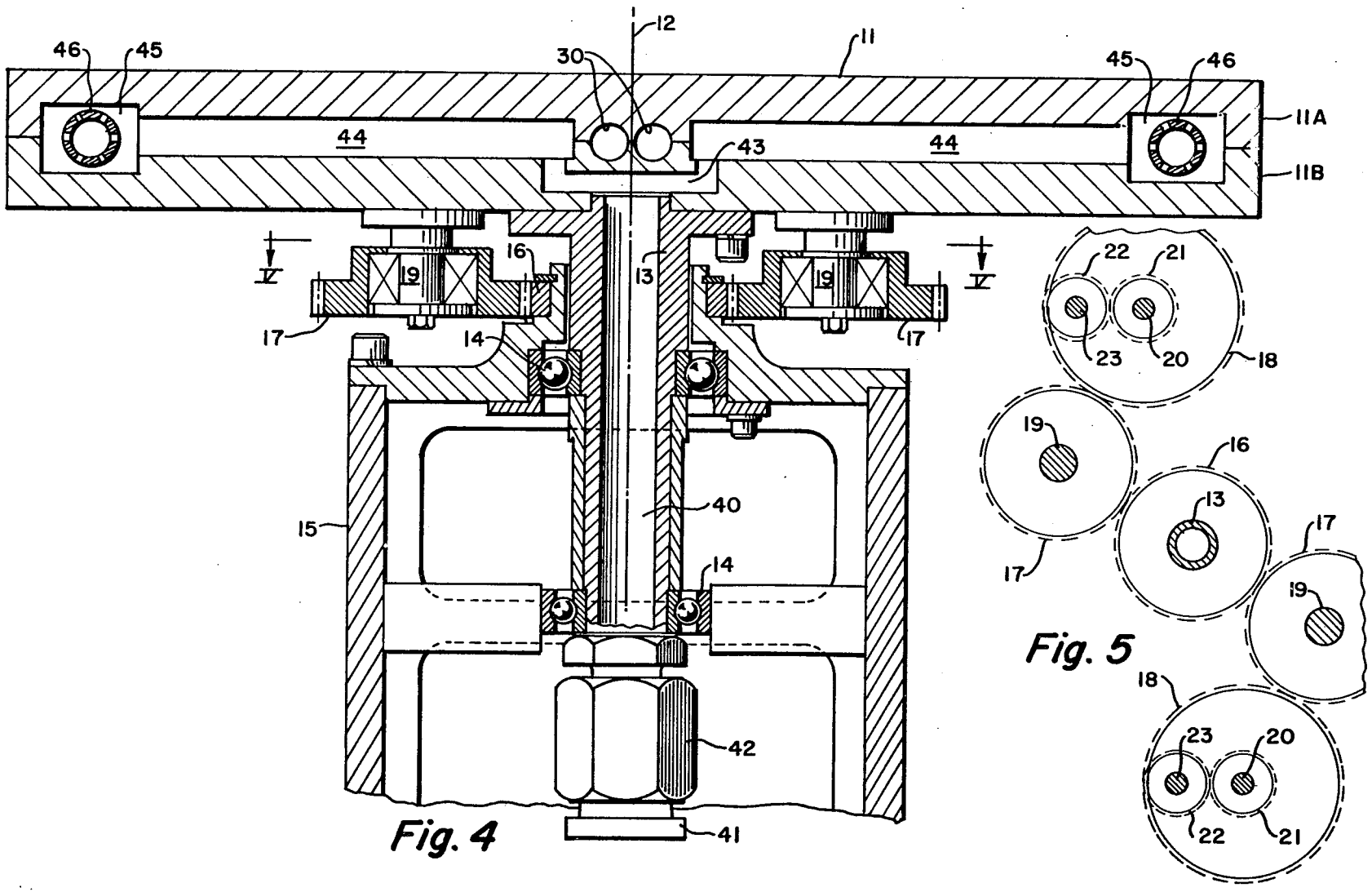
FIG. 4 is a sectional view taken along line IV—IV of FIG. 1.
FIG. 5 is a sectional view taken along line V—V of FIG. 4.

As shown in FIGS. 2, 3 and 5, each idler gear 18 is secured to the lower end of an arbor shaft 20 which extends through an opening in the platform 11. Above gear 18, the arbor shaft 20 carries a timing gear 21 located within a recess in plate 11B. In this recess, the timing gear 21 meshes with a second timing gear 22 secured to an arbor shaft 23. Both arbor shafts 20 and 23 rotate in suitable bearings supported by the platform as shown. The upper ends of arbor shafts 20 and 23 carry pocketed wheels 24 and 25, respectively. As shown in FIGS. 1 and 2, the pocketed wheels have circular recesses uniformly spaced about their outer periphery which are adapted to receive in succession pistons 27 which are typically spheroids.

The respective pairs of pocketed wheel assemblies 24, 25 are arranged at generally, diametrically-opposite locations on the platform 11. Each pair of pocketed wheels forms part of an independent, unidirectional energy converter loop that includes a continuous, closed-loop passageway 30. The two loop passageways take the form of machined slots in each of the mutually-engaging face surfaces of the plates 11A and 11B of the platform 11. In other words, the passageway 30 is defined by aligned slots having walls which are preferably smooth and formed from metal. The passageways are located at mutually-exclusive sectors which lie at opposite sides of a vertical plane passing through the axis 12. The pistons 27 are freely-movable bodies which pass in succession through each passageway. The tolerances or clearances between the surfaces of the pistons 27 and the walls of the passageway 30 are such as to permit the pistons to move freely therealong. Fluid flow past the pistons within the passageways is substantially prevented since the pistons have a spherical shape which is substantially complementary to the cross-sectional shape of the passageways. If desired, a tube can be used as a liner in each passageway.

As shown in FIG. 1, each passageway 30 is made up of three regions 32, 33 and 34. Region 32 extends along the periphery of the platform 11 for a distance of approximately 90°. This region forms an expanding section wherein a fluid medium, such as steam, is used to freely accelerate the pistons in succession. Region 33 is curved inwardly toward the center of rotation of the platform 11 and is provided with one or more ports 31 in the upper plate 11A to bleed off fluid between successive pistons. It should be understood, however, that the ports 31 could be replaced by a plenum chamber which collects the steam, condenses and returns it to a boiler.

As the pistons 27 move radially inwardly in the region 33, they must work against centrifugal force; and in this process the kinetic energy of the moving pistons in region 32 is converted into potential energy as they approach the center of rotation of the platform. Finally, when the pistons are in region 34 in closely-abutting relationship, they are urged radially outwardly under the influence of centrifugal force. In this process, they pass through the pocketed wheels 24 and 25, thereby inducing rotation which is transmitted through idler gears 18 and 17 to central gear 16, thereby causing the entire platform 11 and the elements carried thereby to rotate in the direction indicated by the arrow A in FIG. 1. As the pocketed wheels 24 and 25 rotate, they feed successive ones of the pistons 27 to the first or expander region 32 where they again are propelled in a direction opposite to the direction of rotation of the platform 11.

In FIGS. 1–5, steam is used for the operation of the rotary platform according to a Rankine cycle. The steam is fed from a stationary boiler, not shown, to the rotating platform 11 by means of a duct 40 (FIG. 4) extending through the support shaft 13. The steam is delivered by a stationary conduit 41 through a rotary union 42 and into the duct 40. Duct 40 communicates with a chamber 43 located in the plate 11B below the continuous, closed-loop passageways 30. Radially-extending slots 44, machined into the mutually-engaged face surfaces of plates 11A and 11B, deliver the steam from chamber 43 to supply chambers 45 (see also FIGS. 1 and 2). Disposed within the chambers 45 are bushings 46 with portal openings to deliver steam from the slots 44 into the expander region 32. As shown, the expansible steam is injected into the expander region at the point of juncture between the expander region 32 and the radially-extending region 34. The force exerted by the expanding steam propels the pistons along the expander region to the point where they enter the combined coasting and steam exhaust section formed by region 33. In region 33, the steam is exhausted through ports 31 to the atmosphere as described above or, if desired, a system of ducts may be used to conduct the steam and/or condensate from region 33 through a pipe within duct 40 in shaft 13 for return to the boiler.

In the operation of the invention, the steam injected into the expander region 32 will propel each of the pistons 27 along the periphery of the platform 11, thereby converting the thermal energy of the steam into kinetic energy of the pistons 27. As each of the pistons 27 is propelled forwardly, an equal and opposite reaction is induced tending to rotate the platform in the direction of arrow A. However, as the pistons 27 enter the region 33, their direction of movement changes, thereby producing a force on the platform 11 tending to rotate it in a direction opposite to the direction of arrow A. The two forces thus produced essentially cancel each other so that, as the pistons are propelled around the passageway 30, the net torque on the platform 11 is essentially zero. As the pistons pass through region 33 and work against centrifugal force, their kinetic energy is converted into potential energy as they enter the radially-extending region 34. Now, and assuming that the platform 11 is rotated, the abutting pistons 27 in region 34 will be urged radially outwardly by centrifugal force; and as they pass through the pocketed wheels 24 and 25, torque will be imparted to the pocketed wheels which is coupled through gears 21, 17 and 18 to the stationary gear 16. The energy of the pistons, which are urged radially outwardly by centrifugal force in region 34, is thus converted into rotational energy used to drive the platform 11 in the direction of arrow A as shown in FIG. 1. It will be appreciated that a starter motor or some other device to initially rotate the platform may be required to initiate centrifugal force on the pistons in region 34.

In addition to converting the energy of the pistons into rotational energy, the gear system just described has two other functions. The second function is to maintain the entire rotating system of the rotating energy converter at a desired velocity. The third function of the gear system is to feed the pistons into the expander region 32 and provide thrust to overcome frictional drag of the pistons in the loop passageway.

The two unidirectional energy converter loops according to the invention are disposed at mutually-exclusive sectors which are spaced 180° from each other and supported by the platform 11. While it is possible to use a single closed-loop passageway, it is obviously preferable to use at least two diametrically-opposed passageways in order that the rotating platform 11 will be balanced rotationally. Furthermore, it will be appreciated that a series of platforms such as that shown herein may be stacked in spaced-apart relation for rotation about a common axis 12.

A practical engine incorporating the principles of the invention may, for example, employ a three-foot diameter platform having a thickness twice the diameter of the pistons 27. The rotating engine may incorporate ten unidirectional energy conversion loops having pistons with diameters of 1⅛ inches. Such an engine will develop approximately 50 horsepower while the overall size of the engine will be about three feet in diameter and about one foot long, not including ducting for the steam and exhaust. Under these circumstances, the frequency of the pistons in the passageways would be about 100 per second while the platform rotates at a speed of about 650 revolutions per minute. Such a concept for a rotating engine has a significant potential for practical low-temperature steam engines based on a 66 psia at 300° F. steam inlet pressure and a 3 psia at 140° steam outlet pressure.

Figure 6:
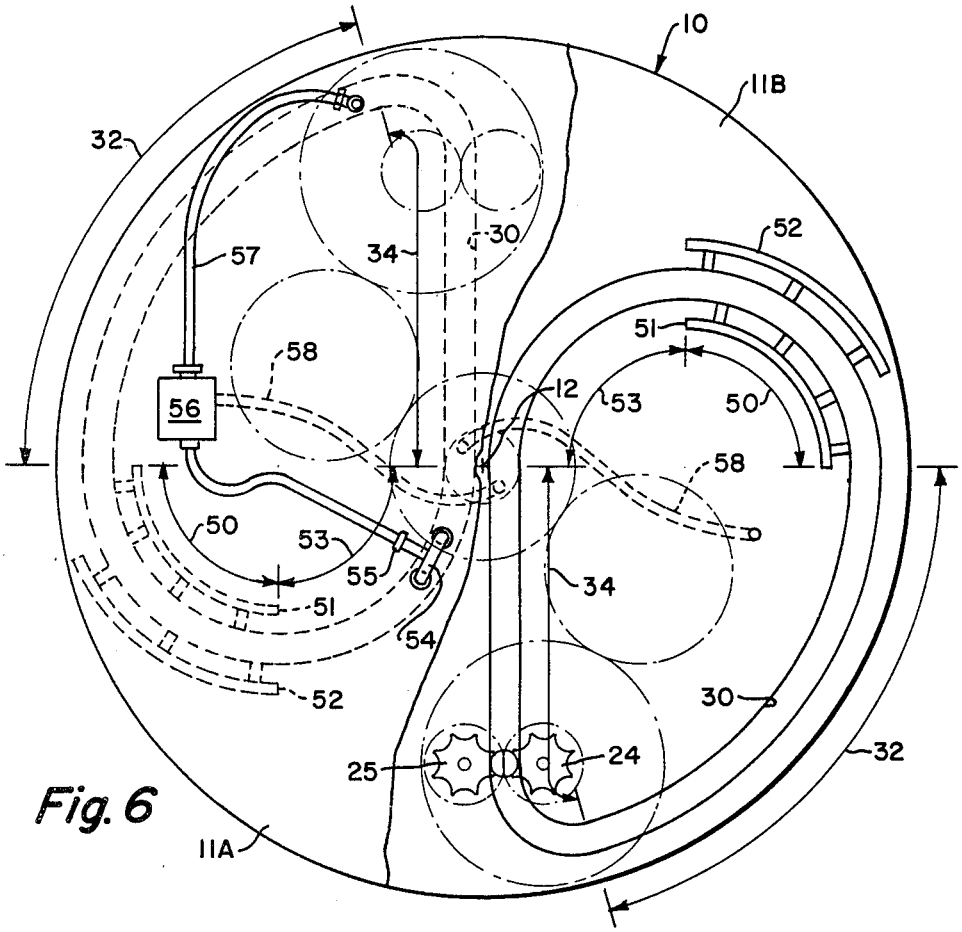
FIG. 6 is a plan view similar to FIG. 1 but illustrating the apparatus of the present invention for operation according to the Brayton cycle.

FIG. 6 illustrates another embodiment of the invention incorporating the principles of the Brayton cycle. Because of the similarity between the parts forming the rotating engine for a Brayton cycle and the parts forming a rotating engine for operation according to the Rankine cycle as just described, elements of FIG. 6 which correspond to those of FIG. 5 are identified by like reference numerals. The expander region 32 of each continuous, closed-loop passageway 30 curves along a 90° circumferential part of the platform 11. A combined exhaust and intake section 50 receives the pistons from the expander region 32. An exhaust manifold 51 delivers the exhaust gases carried between successive pistons. The exhaust gases are replaced by fresh air from an inlet manifold 52. From region 50, the pistons pass into a compression region 53. The gases compressed between the pistons are delivered by a manifold 54 at an increased pressure through a check valve 55 and into a combustion chamber 56. The compressed air is heated in the combustion chamber and introduced into the unidirectional energy conversion loop by an inlet conduit 57. The heated air accelerates the pistons in succession along the expander region 32. Liquid fuel is fed from a stationary tank on the rotating platform through a coaxial pipe in shaft 13 with a rotating shaft seal. The fuel is then fed by a conduit 58 into the combustion chamber 56.

As each piston exits from the expander region 32 in succession, the velocity of the piston is at a maximum relative to the unidirectional energy conversion loop formed by its passageway 30. The kinetic energy of the piston is thus converted into potential energy as the pistons approach the center of the rotating platform 11 in passing through arcuate regions 50 and 53. The kinetic energy of the piston is also expended by compression of air to form the compressed air supply which is fed into the combustion chamber and then, when heated, fed into the expander inlet. In the radially-extending region 34 of the passageway, the pistons apply centrifugal force to the pocketed wheels. The mechanical power formed by the unidirectional energy conversion loop is the net centrifugal force imparted to the platform through the sprocket-gear train.

The second unidirectional energy conversion loop supported by the platform 11 in FIG. 6 is identical to the first and positioned diametrically opposite the first loop. It is again apparent that a series of platforms 11 may be stacked in superimposed spaced-apart relation along the same axis 12. Thus, the unidirectional energy conversion engine operating according to the Brayton cycle may consist of multiple unidirectional energy conversion loops as was the case with the embodiment of FIGS. 1–5.

Figure 7:
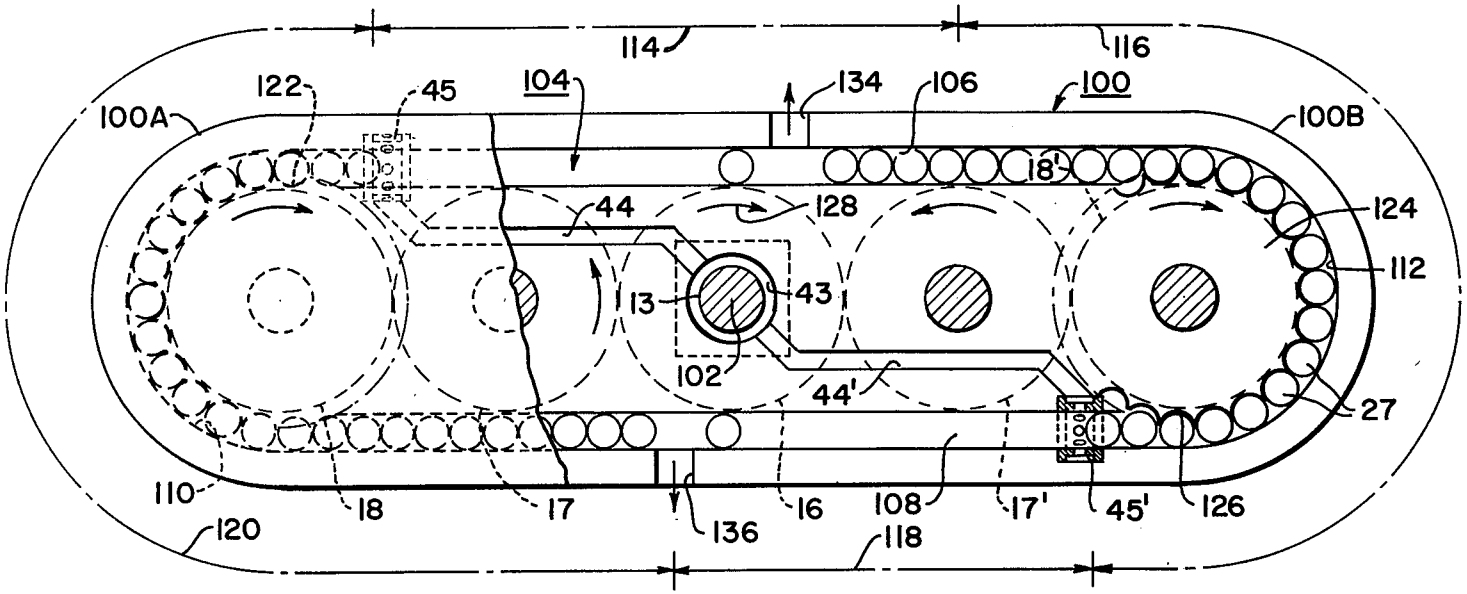
FIG. 7 is an illustration, in partially broken-away plan view, of another embodiment of the invention wherein a single loop passageway extends around the axis of rotation of a platform, there being two regions in the passageway where pistons are propelled against centrifugal force.
Figure 8:
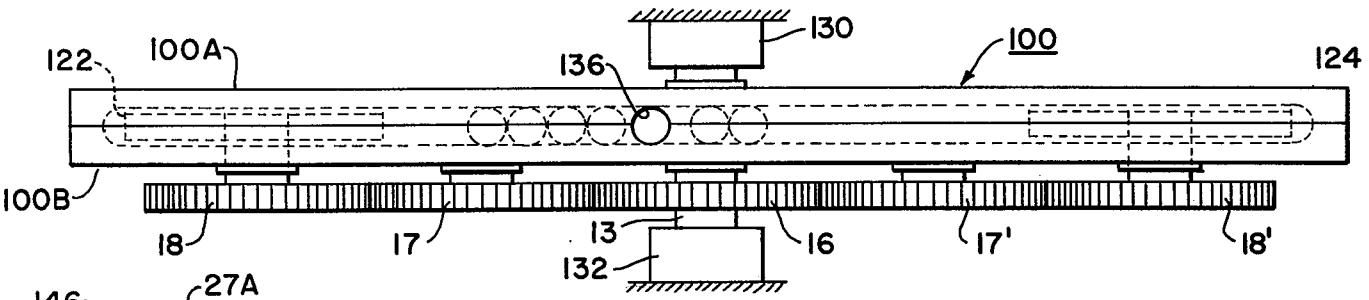
FIG. 8 is a side view of the embodiment of the invention shown in FIG. 7.

FIGS. 7 and 8 illustrate another embodiment of the invention wherein a single passageway is utilized on a rotating platform rather than two passageways as in the embodiment of FIGS. 1–6. Since many of the parts forming the rotating engine of the embodiment of FIGS. 7 and 8 are the same or similar to those of FIGS. 1–6, certain elements of FIGS. 7 and 8 which correspond to those of FIGS. 1–6 are identified by like reference numerals.

In the rotating unidirectional energy converter shown in FIGS. 7 and 8, a platform 100 is provided which rotates about a central axis 102. The platform 100 is elongated but symmetrical about the axis of rotation 102 and is, therefore, balanced about the axis of rotation. The platform 100 can be formed from upper and lower halves 100A and 100B as shown in FIG. 8. Formed in the upper and lower halves 100A and 100B is a single continuous, closed-loop passageway 104 having two straight portions 106 and 108 on opposite sides of the axis of rotation 102. The opposite ends of the straight portions 106 and 108 are interconnected by curved portions 110 and 112, respectively, the portions 110 and 112 also being on opposite sides of the axis of rotation 102 of the platform 100. Thus, opposite sides of the passageway 104 are arranged symmetrically, and balanced, about the axis of rotation 102. The platform 100 is generally elliptical in shape, meaning that it is long as compared to its width, having semicircular end portions connected by straight portions. Instead of forming the passageway 104 from upper and lower plates 100A and 100B, it is also possible to form the passageway from a tube which is rigidly mounted on a rotatable platform, not shown. Other forms of construction will be readily apparent to those skilled in the art.

The loop passageway 104 is made up of four regions. These comprise a first expander region 114, a first thruster region 116, a second expander region 118 and a second thruster region 120. Rotatable thruster wheels 122 and 124 are mounted for rotation on the platform at the respective axes of the two curved end portions 110 and 112 of passageway 104. The thruster wheels 122 and 124 are provided with pockets 126, uniformly spaced about their outer peripheries, which are adapted to engage successive pistons 27 through the open inner faces of the curved end portions 110 and 112 of the passageway 104. As the pocket thruster wheels 122 and 124 rotate, they serve to move successive pistons through the curved end portions 110 and 112 and into the respective expander regions 114 and 118. The rotating thruster wheels also serve to drive the rotating platform 100 and the shaft 13 connected thereto through central, stationary main gear 16 and appropriate idler gears 17 and 17' located beneath the platform 100. Idler gears 17 and 17', in turn, mesh with gears 18 and 18' connected to the rotatable pocket wheels 122 and 124, respectively, as best shown in FIG. 8. Thus, as the pocket wheels 122 and 124 rotate in the direction of the arrows shown in FIG. 7, torque will be transmitted to the shaft 13 to cause it and the platform 100 connected thereto to rotate in the direction of arrow 128. The shaft 13 may be conveniently journaled in bearings 130 and 132 as shown in FIG. 8.

In the operation of the embodiment shown in FIGS. 7 and 8, an ideal diatomic gas (e.g., air or steam) at a pressure elevated above ambient (i.e., from a compressor, boiler or the like) is introduced into the passageway 104 via inlet port 45 located between the second thruster region 120 and the first expander region 114, and via inlet port 45' located between the first thruster region 116 and the second expander region 118. Gas is exhausted from the passageway via a venting port (or ports) 134 located between the first expander region 114 and the first thruster region 116, or via port (or ports) 136 located between the second expander region 118 and the second thruster region 120. The pistons 27 act as porting valves at the inlet and venting ports as in the embodiment of FIGS. 1–6. Passageways of slots 44 and 44' can be provided to deliver steam or another expansible fluid from chamber 43, similar to chamber 43 shown in FIG. 4, to the inlet ports 45 and 45'.

The pressurized gas entering the first expander region 114 through inlet port 45 drives successive pistons 27 through the expander region 114 against the centrifugal force field generated by rotation of the platform 100. That is, the pistons must work against centrifugal force as they approach the center of rotation of platform 100. When the next piston closes off the inlet port 45, the unit cell of gas between the pistons is closed off from the inlet port 45 and expands adiabatically as the lead piston moves through the expander region. When the piston ahead of the piston in the expander region 114 traverses venting port 134, the unit cell of gas ahead of the piston still in the expander region 114 is exhausted through the venting port. The piston in the expander region then arrives at the beginning of the thruster region 116 and closes off the venting port 134; while the ensuing piston is driven through the expander region in accordance with the cycle just described.

Upon leaving the expander region 114, the piston enters the thruster region 116 which is filled with pistons. When the pistons are in the thruster region, in closely-abutting relationship, they are urged toward the curved end portion 112 of the passageway 104 under the influence of centrifugal force. That is, they are urged outwardly in relation to the axis of rotation 102 of the platform 100 by centrifugal force. In this process, they engage the pocketed thruster wheel 124 and impart torque thereto, causing it to rotate with the rotation being transmitted through gears 18' and 17' to central gear 16, thereby causing the entire platform 100 and the drive shaft 13 to rotate in the direction indicated by arrow 128 in bearings 130 and 132 (FIG. 8). The energy of the pistons, which are urged outwardly by centrifugal force in regions 116 and 120, is thus converted into rotational energy of the platform. Instead of using gears as in the embodiment shown in FIGS. 7 and 8, it is, of course, also possible to utilize drive chains or other suitable means in accordance with well-known techniques.

As the thruster wheels 122 and 124 rotate, they feed successive ones of the pistons to the expander regions 114 and 118 where the cycle described above is repeated. In addition to converting the energy of the pistons 27 into rotational energy, the gear system described above has two other functions. The second function is to maintain the entire rotating system of the rotating energy converter at a desired velocity. The third function of the gear system is to feed the pistons into the expander regions 114 and 118 and to provide thrust to overcome frictional drag of the pistons in the loop passageway.

It can thus be seen that the rotating passageway 104 of the embodiment of FIGS. 7 and 8 comprises, in series, a first expander region 114, a first thruster region 116, a second expander region 118 and a second thruster region 120. This is in contrast to the embodiments shown in FIGS. 1–6 wherein each passageway comprises only one expander region and one thruster region. However, except as noted above, this embodiment functions in a manner generally similar to the embodiments previously discussed. A starter motor or some other device to initially rotate the platform 100 may be required to initiate centrifugal force on the pistons in regions 116 and 120.

In the embodiment shown in FIGS. 7 and 8, steam may be used for the operation of the rotating platform 100 in accordance with the Rankine cycle as in the previously-described embodiments. When steam is used, the force exerted by the expanding steam, which enters the passageway 104 through ports 45 and 45', propels the pistons 27 through the expander regions 114 and 118. The steam is exhausted through venting ports 134 and 136 as the pistons enter the thruster regions 116 and 120. Venting ports 134 and 136 may be open to the atmosphere or, if desired, a system of ducts, not shown, may be used to return the steam and/or condensate to the boiler in a manner similar to that of FIG. 4.

While the rotating engine as shown in FIGS. 7 and 8 may operate in accordance with the thermodynamic principles of the Rankine cycle as described above, this embodiment of the invention, appropriately modified, may also function in accordance with the principles of the Brayton, Diesel, or Otto cycles as briefly described below.

In the operation of the embodiment of FIGS. 7 and 8 according to the Brayton cycle, compressed gas (typically air) is heated in a combustion chamber rotating on the platform as in FIG. 6, or by a heat exchanger rotating on the platform, with the heat exchanger being connected to a stationary external heat source via a coaxial duct. The heated, compressed gas is then introduced into the expander regions from appropriate conduits via the inlet ports. After expansion, the gas is exhausted at ambient pressure via the venting ports 134 and 136 either directly to the atmosphere or through a coaxial duct. The compressed gas may be obtained via conventional compressor means, either stationary or rotating on the platform; however, it is preferred to obtain the compressed gas from a separate unidirectional energy converter loop which is rotating about the same axis of rotation (i.e., stacked above or below the platform), and which is adapted to function as a compressor in the manner described in connection with FIGS. 7 and 8 hereinafter or as described in U.S. Pat. No. 3,859,789, Fawcett et al.

In the operation of the embodiment of FIGS. 7 and 8 in accordance with the principles of the Diesel cycle, an expanding gas is provided in the expander regions by way of internal combustion within these regions. Compressed air (typically from one of the sources described above in reference to the Brayton cycle) is introduced into the regions via the inlet ports 45 and 45'. Liquid or gaseous fuel is fed into the expander regions 114 and 118 when the inlet ports are closed off by the pistons leaving the thruster regions. Combustion takes place in the expander regions and is cycled to effect expanding gas behind each piston as it enters the expander regions 116 and 120. That is, combustion takes place periodically to propel successive ones of the pistons through the expander regions. As with the Brayton cycle, the combustion gases may be exhausted at ambient pressure via the venting port directly to the atmosphere or through a coaxial duct.

The operation of the embodiment of FIGS. 7 and 8 according to the Otto cycle is similar to that described above regarding the Diesel cycle. The fuel and air may be separately introduced into the expander regions, as in the Diesel cycle, or the fuel may be mixed with the incoming air before or after it is compressed. Ignition of the fuel-air mixture is effected in the expander regions 114 and 118 by means of a conventional spark system located in an appropriate recessed area in these regions. As in the Diesel cycle, combustion is cycled to effect expanding gas successively behind each piston as it passes so as to propel successive ones of the pistons through the expander regions.

If the platform 100 shown in FIGS. 7 and 8 is rotated by a motor or some other external power source in a direction opposite that shown, gas at ambient pressure will be taken into the passageway 104 via ports 134 and 136 and will be exhausted at an elevated pressure via ports 45 and 45'. In this regard, the system can function as a compressor. If the platform 100 is rotated by a motor, the system of gears interconnecting the thruster wheels 122 and 124 to the central shaft 13 will act to rotate the thruster wheels. The rotating thruster wheels will then move the stacked pistons 25 in the thruster regions toward the axis of rotation of the platform, so that upon passing ports 134 and 136, the pistons will travel through the expander regions 114 and 118 under the influence of centrifugal force. The gas between the pistons will be adiabatically compressed by the moving pistons in the expander regions 116 and 120 which would more properly be termed "compressor regions" in this mode.

It will also be appreciated that a series of unidirectional energy converters may be stacked in superimposed, spaced-apart relation for rotation upon shaft 13 about the common axis 102. In the embodiment of FIGS. 7 and 8, the following general observations can be made: (1) the change in enthalpy of the gas in the expander regions produces net work, which is performed on the thruster wheels 122 and 124 via the pistons 27, and then transmitted to the rotating platform 100 and the shaft 13; (2) the change in enthalpy of the gas in the expander regions transfers energy via the centrifugal field (potential) energy stored in the mass of the pistons as they move through the expander regions from a larger radius of rotation (i.e., about the axes of rotation of the platform 100) to a smaller radius of rotation (i.e., nearer the axis of rotation); (3) the initial and final velocities of the pistons traveling in the expander regions relative to the rotating platform are equal; and (4) the inlet and venting gas port sizes, the mass of the pistons, the speed of rotation of the thruster wheels and the platform, and the inlet and exit states of the gas are all interrelated in the operation of, and the net work produced in, this system. Under some conditions of operation, the gas pressure in the expander region during part of the operating cycle may be below ambient.

Figure 9B:
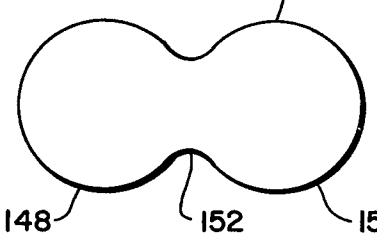
FIGS. 9A and 9B illustrate alternative forms of the pistons which can be used in the two embodiments of the invention.
Figure 9A:
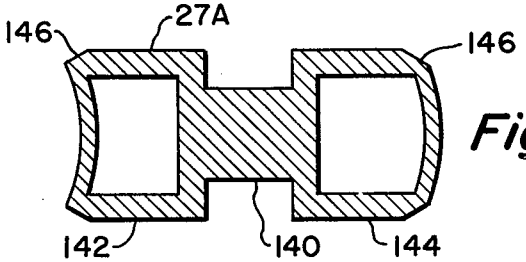

In FIGS. 9A and 9B, alternative forms of the pistons 27 are shown. In FIG. 9A, the piston 27A comprises a body having a central annular slot 140 and large diameter end portions 142 and 144 provided with spherically-beveled edges 146 which can engage the periphery of the passageway 104 as the pistons 27A pass around the curved portions 110 and 112. The large diameter portions 142 and 144 are hollow as shown. The configuration shown in FIG. 9A comprises, in effect, two interconnected pistons separated by the reduced diameter portion 140 which receives the radially, outwardly-projecting prongs on the pocketed wheels 122 and 124 as the pistons move around the curved portions 110 and 112.

Lightly-loaded piston rings (not shown) may optionally be located in recesses formed within the outer surface of the pistons, so as to reduce losses due to leakage of the fluid medium around the pistons.

FIG. 9B is similar to that of FIG. 9A except that the piston 27B in this case comprises two spherical end portions 148 and 150 interconnected by reduced diameter portion 152 which again receives the radially, outwardly-projecting prongs on the thruster wheels 122 and 124.

A piston such as that shown in FIG. 9A, or some other configuration having a cylindrical outer periphery (as contrasted to a sphere) may be preferable in order that the cylindrical surface can more positively close off the ports 134 and 136 as they pass thereby. In this respect, the ports 134 and 136 should be as small in cross section as possible while affording the required flow volume therethrough.

The embodiments of the invention described above utilize an arrangement wherein the pocketed thruster wheels are mechanically linked (i.e., coupled) to both the rotating platform and the engine drive shaft via a system of gears or drive chains, etc. In an alternative preferred embodiment of the invention it may be desirable to decouple the thruster wheels from the platform, and to provide a separate, external drive motor which can be utilized to separately drive the rotating platform at a speed of rotation which is independent from that of the pocketed thruster wheels. It is apparent that the speed of rotation of the platform is related to the torque produced by the rotating engine of the present invention, whereas the speed of rotation of the thruster wheels is proportional to the rate of torque applied to the engine shaft (i.e., shaft power). By providing a separate drive motor to independently drive the platform, the rotating engine of the present invention can be utilized to produce torque independently from engine drive shaft speed (i.e., high torque can be produced at low or variable speed).

As was explained in the introductory portion of the specification, it is also possible to use the various embodiments of the invention previously described as compressors. In the embodiment shown in FIGS. 1-5, for example, the platform 11 can be rotated in a direction opposite to that indicated by arrow A, in which case the pocketed wheels 24 and 25 will force the pistons 27 radially inwardly along region 34. In region 33, the pistons are forced radially outwardly while drawing air into the passageway 30 through ports 31. The pistons 27, propelled radially outwardly by centrifugal force, then travel through region 32 and in so doing compress the air between successive ones of the pistons such that their kinetic energy is converted into compressed gas. The compressed gas then exits the passageway 30 through the portal openings in the bushing 46 and is conveyed through slot 44 to the duct 40.

The platform 11 may be driven by suitable gearing coupled to the shaft 13, by gearing which meshes with a ring gear carried on the periphery of the platform 11, or by a shaft which is coaxial with shaft 13 on the opposite side of the platform 11. The same alternatives are possible to derive rotary energy from the device when used as an engine. When plural energy conversion devices are employed in superimposed spaced-apart relation along the same axis 12, they may be interconnected by means of the hollow shaft 13 from which rotary energy is derived by way of suitable gearing. In the case of only two energy converters on the same shaft, it is apparent that the platforms 11 could be directly interconnected in back-to-back relationship.

Although the invention has been shown in connection with certain specific embodiments, it will be readily apparent to those skilled in the art that various changes in form and arrangement of parts may be made to suit requirements without departing from the spirit and scope of the invention. In this respect, gear 16 need not be stationary relative to the fixed engine frame but only rotating at some velocity other than that of the rotating platform.

We claim as our invention:

1. Apparatus for converting a first form of energy into a second form of energy comprising a platform, support means for carrying said platform for rotation about a central axis, at least one continuous, closed-loop passageway carried by the platform in a plane extending perpendicular to said central axis, a plurality of freely-movable pistons contained within the passageway, at least one region in the passageway in which the pistons must move inwardly against centrifugal force as said platform rotates, at least one other region in the passageway where said pistons are moved outwardly under the influence of centrifugal force, means for imparting a force to successive ones of the pistons to propel them against centrifugal force in said one region, means for converting the energy of pistons moving outwardly under the influence of centrifugal force in said other region into rotational energy, and means coupling said rotational energy to said platform to rotate the same.

2. The apparatus according to claim 1 wherein said means for imparting a force to successive ones of the pistons includes a conduit directing a fluid for expansion between said pistons to said one region of the passageway.

3. The apparatus according to claim 2 wherein each of said plurality of freely-movable pistons is of a shape substantially complementary to the cross-sectional shape of said closed-loop passageway so as to substantially seal the passageway from fluid flow around said pistons and subdivide said fluid into segments.

4. The apparatus according to claim 1 wherein said means for imparting a force includes a duct extending in a generally radial direction from said central axis about which said platform rotates to said one region of the passageway, and conduit means at said central axis communicating with said duct to feed an expansible fluid medium into said one region of said passageway.

5. The apparatus according to claim 1 wherein said passageway is provided with one or more ports positioned to bleed fluid from the passageway to reduce pressure in front of the pistons and promote their acceleration under the influence of centrifugal force.

6. The apparatus according to claim 1 wherein said means for converting the energy of the pistons into rotational energy includes a wheel having circumferentially-spaced peripheral pockets for receiving successive ones of said pistons at one side of said passageway in said other region thereof.

7. The apparatus according to claim 6 including idler gear means coupled to said wheel and in meshing engagement with gear means mounted coaxially with said central axis.

8. The apparatus according to claim 1 wherein the apparatus operates according to the Rankine cycle.

9. The apparatus according to claim 8 wherein said means for applying a force in said one region comprises expanding steam under pressure.

10. The apparatus according to claim 1 wherein the apparatus operates according to the Brayton cycle, and said means for applying a force in said one region comprises an expanding gas produced by combustion of a fuel.

11. The apparatus according to claim 10 including a first manifold in said passageway for exhausting products of combustion, and a second manifold in said passageway for supplying air to said passageway which is compressed between successive ones of said pistons.

12. The apparatus according to claim 11 including a combustion chamber, means for supplying compressed air from said passageway to said combustion chamber, means for supplying fuel to said combustion chamber and for burning the fuel therein, and means for supplying compressed gases comprising the products of combustion from said combustion chamber to said one region of the passageway to propel successive ones of the pistons therein.

13. Apparatus for converting a first form of energy into a second form of energy comprising a platform, support means for carrying said platform for rotation about a central axis, at least one continuous, closed-loop passageway carried by the platform in a plane extending perpendicular to said central axis, a plurality of freely-movable pistons contained within the passageway, means for applying a force to successive ones of the pistons in a first region of the passageway extending along the periphery of the rotating platform to thereby propel each piston in one direction around the passageway and increase its kinetic energy, a second region of the passageway being shaped to cause the pistons, after being propelled, to work against centrifugal force to thereby convert the kinetic energy of the pistons into potential energy as they approach the center of rotation of the platform, a third radially-extending region of the passageway where said pistons are moved radially outwardly back to said first region under the influence of centrifugal force, means for converting the energy of pistons moving radially outwardly in said third region into rotational energy, and means coupling said rotational energy to said platform to rotate the same.

14. The apparatus of claim 13 wherein there are two continuous, closed-loop passageways containing a plurality of freely-movable pistons, said passageways being diametrically opposite each other on the rotating platform.

15. The apparatus according to claim 13 wherein said passageway includes at least two arcuate regions.

16. The apparatus according to clain 14 wherein each of said passageways includes a radially-extending linear region interconnecting said two arcuate regions.

17. The apparatus according to claim 13 wherein said means for applying a force to successive ones of the pistons includes a conduit directing a fluid medium for expansion between said pistons into the first region of said passageway.

18. The apparatus according to claim 13 wherein each of said plurality of freely-movable pistons is of a shape substantially complementary to the cross-sectional shape of said closed-loop passageway so as to substantially seal the passageway from fluid flow around said pistons and subdivide said fluid into segments.

19. The apparatus of claim 13 wherein said platform comprises a disc, and a support shaft coaxial with said central axis for supporting said disc.

20. The apparatus according to claim 19 wherein said support shaft is secured to said disc.

21. The apparatus according to claim 19 wherein said means for applying a force includes a duct extending in a generally radial direction from said central axis about which said platform rotates to said first region of the passageway, and conduit means communicating with said duct to feed an expansible fluid medium into the first region of said passageway.

22. The apparatus according to claim 13 wherein said passageway is provided with one or more ports positioned to bleed fluid from the passageway to reduce the pressure in front of the pistons and promote their acceleration in the second region thereof.

23. The apparatus according to claim 13 wherein said means for converting potential energy into rotational energy includes a wheel having circumferentially-spaced peripheral pockets for receiving successive ones of said pistons at one side of said passageway in the third region thereof.

24. The apparatus according to claim 23 including idler gear means coupled to said wheel and in meshing engagement with stationary gear means mounted coaxially with said central axis.

25. The apparatus according to claim 14 wherein, for each passageway, said means for converting potential energy into rotational energy includes spaced-apart wheels projecting into opposite sides of the path of travel of said pistons in the third region of said passageways, each wheel having circumferentially-spaced peripheral pockets to advance each piston received therebetween along a passageway.

26. The apparatus according to claim 25 including idler gear means coupled to each pocketed wheel while drivingly engaging stationary gear means mounted coaxially with said central axis.

27. Apparatus for converting a first form of energy into a second form of energy comprising a platform, support means for carrying said platform for rotation about a central axis, a continuous, closed-loop passageway carried by the platform in a plane extending perpendicular to said central axis, a plurality of freely-movable pistons contained within the passageway, said passageway having essentially straight portions on opposite sides of said central axis, said straight portions being interconnected at their opposite ends by curved portions also on opposite sides of said central axis, means for applying a force to successive ones of the pistons in one region of each of said straight portions to propel them inwardly on the rotating platform against centrifugal force, said pistons being moved radially outwardly in another region of each of said straight portions under centrifugal force, means for converting the energy of pistons in said curved portions which have been moved outwardly under centrifugal force into rotational energy, and means for coupling said rotational energy to said platform to rotate the same.

28. The apparatus of claim 27 wherein said means for converting potential energy into rotational energy includes a wheel having circumferentially-spaced peripheral pockets for receiving successive ones of said pistons in a curved portion of said passageway.

29. The apparatus according to claim 27 wherein the outer periphery of said wheel substantially coincides with the inner periphery of a curved portion of said passageway.

30. The apparatus according to claim 28 including idler gear means coupled to said wheel and in meshing engagement with stationary gear means mounted coaxially with said central axis.

31. The apparatus of claim 30 wherein there are wheels for receiving successive ones of the pistons in each curved portion of the passageway, the idler gear means coupling both of said wheels to said stationary gear means.

32. The apparatus according to claim 27 including a region in each of said straight portions of said passageway where pistons are propelled by expansion of a gas, and another region where pistons are propelled by centrifugal force.

33. Apparatus for converting a first form of energy into a second form of energy comprising a platform, support means for carrying said platform for rotation about a central axis, at least one continuous, closed-loop passageway carried by the platform in a plane extending perpendicular to said central axis, a plurality of freely-movable pistons contained within the passageway, at least one region in the passageway in which the pistons move inwardly against centrifugal force as said platform rotates, at least one other region in the passageway where said pistons are moved outwardly under the influence of centrifugal force, means for imparting a force to successive ones of the pistons to move them against centrifugal force in said one region, and means for converting the energy of pistons moving outwardly under the influence of centrifugal force in said other region into another form of energy.

34. The apparatus according to claim 33 wherein plural platforms, each including all of the elements of claim 33, are coupled together for simultaneous rotation about said central axis.

35. Apparatus for converting rotational energy into a compressed gas comprising a platform, support means for carrying said platform for rotation about a central axis, at least one continuous, closed-loop passageway carried by the platform in a plane extending perpendicular to said central axis, a plurality of freely-movable pistons contained within the passageway, at least one region in the passageway in which the pistons move radially inwardly against centrifugal force as said platform rotates, at least one other region in the passageway where said pistons are moved radially outwardly under the influence of centrifugal force, port means in said other region for drawing a gas to be compressed into said passageway, means for imparting a force to successive ones of the pistons to move them against centrifugal force in said one region of the passageway, said gas drawn into said other region being compressed by the kinetic energy of pistons moved outwardly under the influence of centrifugal force, means for withdrawing said compressed gas from said passageway, and means for rotating said platform.

36. The apparatus of claim 35 wherein the means for imparting a force to successive ones of the pistons to propel them against centrifugal force in said one region includes a wheel having circumferentially-spaced peripheral pockets for receiving successive ones of said pistons and for forcing them radially inwardly in said one region.

37. The apparatus according to claim 36 including idler gear means coupled to said wheel and in meshing engagement with gear means mounted coaxially with said central axis.

38. The apparatus according to claim 37 wherein there are two wheels having circumferentially-spaced peripheral pockets on opposite sides of said passageway in said one region for forcing successive ones of the pistons radially inwardly against centrifugal force.

39. The apparatus of claim 35 wherein there are two closed-loop passageways carried by the platform, the passageways being arranged diametrically opposite each other to achieve balanced rotation of the platform.

40. The apparatus of claim 33 wherein said one region and said other region are interconnected by a third region extending along the circumference of said platform.

* * * * *